US005873268A

United States Patent [19]

Spriggs et al.

[11] Patent Number: 5,873,268

[45] Date of Patent: Feb. 23, 1999

[54] DISPENSER

[75] Inventors: John Ross Spriggs, Minneapolis; Loleta T. Tolliver-Rogers, Chanhassen; Daniel K. Boche, Eagan; Ronald Bruce Howes, Minneapolis; Douglas Sherwin Hoerning, Cottage Grove, all of Minn.

[73] Assignee: Ecolab Inc., St. Paul, Minn.

[21] Appl. No.: 919,851

[22] Filed: Aug. 28, 1997

Related U.S. Application Data

[62] Division of Ser. No. 644,620, May 6, 1996, Pat. No. 5,782, 109.

[51] Int. Cl.[6] ..... D06F 39/02

[52] U.S. Cl. ..... 68/17 R; 116/202; 116/227; 137/268; 239/310; 422/263; 422/266

[58] Field of Search ..... 68/17 R; 134/93; 422/263, 266; 239/310; 137/268; 116/202, 227

[56] References Cited

U.S. PATENT DOCUMENTS

| | | | |
|---|---|---|---|
| 2,431,121 | 11/1947 | Hunter . | |
| 2,457,345 | 12/1948 | Carline . | |
| 2,957,503 | 10/1960 | Stifter . | |
| 3,178,915 | 4/1965 | Hertel | 134/93 X |
| 3,306,493 | 2/1967 | Szajna . | |
| 3,637,109 | 1/1972 | Stifter . | |
| 3,990,272 | 11/1976 | Gakhar . | |
| 4,129,230 | 12/1978 | Billett et al. | 422/266 X |
| 4,250,911 | 2/1981 | Kratz | 239/310 X |
| 4,408,700 | 10/1983 | Fillmore et al. . | |
| 4,528,709 | 7/1985 | Getz et al. . | |
| 4,687,121 | 8/1987 | Copeland . | |
| 4,693,415 | 9/1987 | Sturm . | |
| 4,836,229 | 6/1989 | Lakhan et al. . | |
| 4,938,240 | 7/1990 | Lakhan et al. . | |
| 5,007,559 | 4/1991 | Young | 422/266 X |
| 5,092,141 | 3/1992 | Quinn . | |
| 5,192,000 | 3/1993 | Wandrick et al. . | |
| 5,194,230 | 3/1993 | PeKarna et al. . | |
| 5,199,645 | 4/1993 | Anderson et al. . | |
| 5,267,676 | 12/1993 | Lord et al. . | |
| 5,279,157 | 1/1994 | Mattis et al. . | |
| 5,294,357 | 3/1994 | Ally et al. . | |
| 5,326,481 | 7/1994 | Alwerud . | |
| 5,407,093 | 4/1995 | McGill . | |
| 5,417,939 | 5/1995 | Bunschoten et al. | 422/263 X |
| 5,577,527 | 11/1996 | Jacobs et al. | 422/266 X |

FOREIGN PATENT DOCUMENTS

| | | |
|---|---|---|
| 2 335 190 | 7/1977 | France . |
| 4124376 | 2/1992 | Germany . |
| 2239893 | 9/1990 | Japan . |
| 4033695 | 2/1992 | Japan . |
| 4035690 | 2/1992 | Japan . |
| 7047191 | 2/1995 | Japan . |
| 9403818 | 5/1994 | Rep. of Korea . |
| 9403822 | 5/1994 | Rep. of Korea . |

*Primary Examiner*—Philip R. Coe
*Attorney, Agent, or Firm*—Merchant, Gould, Smith, Edell, Welter & Schmidt, P.A.

[57] ABSTRACT

A dispenser 100 for dispensing a chemical product that is dissolved by diluent. The dispenser includes a package 170 having a diaphragm, or fingered collar 180 attached to its opening. The diaphragm 180 has a plurality of flexible members or flexible fingers 185. The dispenser may utilize an injection manifold 109 that is sized and configured to be positioned on a washing machine top proximate the gap between the washing machine's top and lid. Still further, the invention includes a low level chemical product indicator. The indicator includes a focused light source 98*a* and 99*a*. The focused light source is a high intensity light emitting diode having a viewing angle of less than 6° and an intensity of above 10,000 mcd. The dispenser also includes an apparatus and method in which a dispensing time of a dispenser is dynamically varied in response to diluent temperature during operation of the dispenser.

8 Claims, 10 Drawing Sheets

FIG. 4
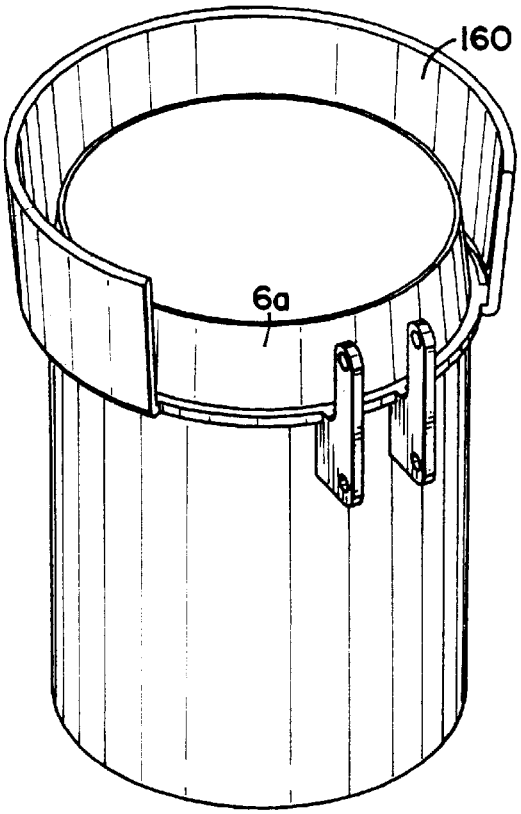
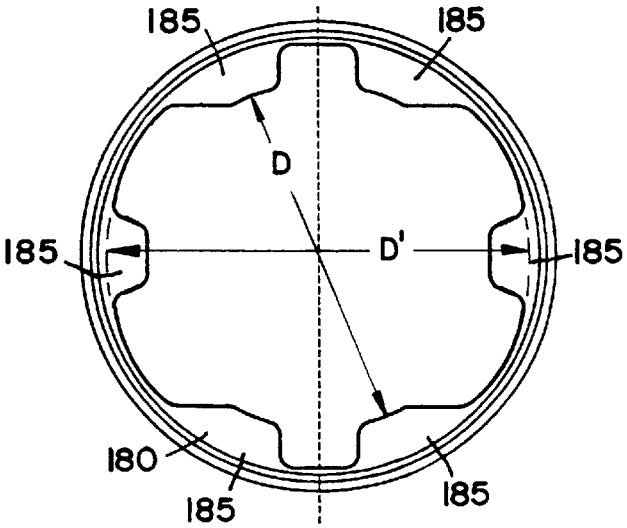
FIG. 5

FIG. 8
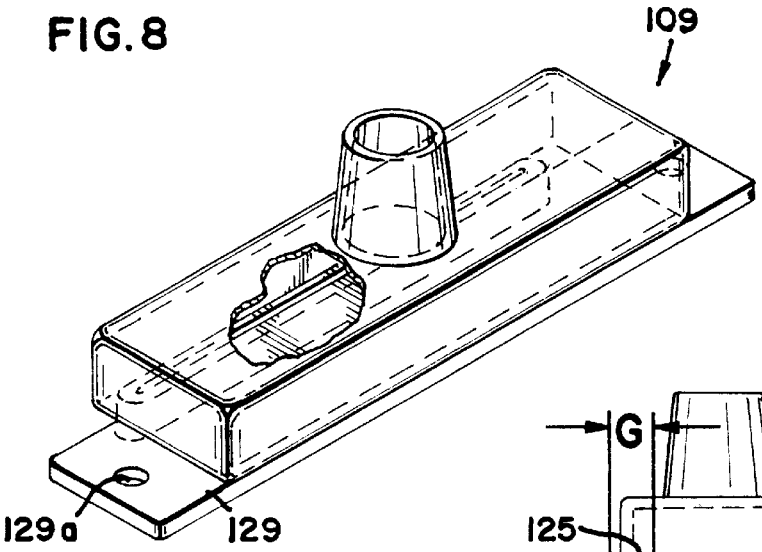
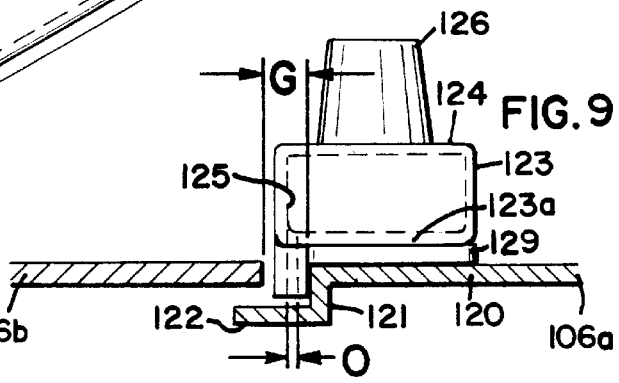
FIG. 9
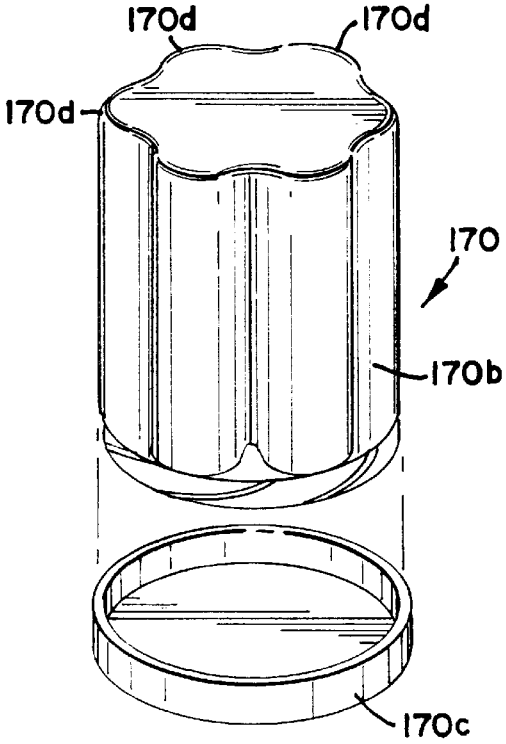
FIG. 7
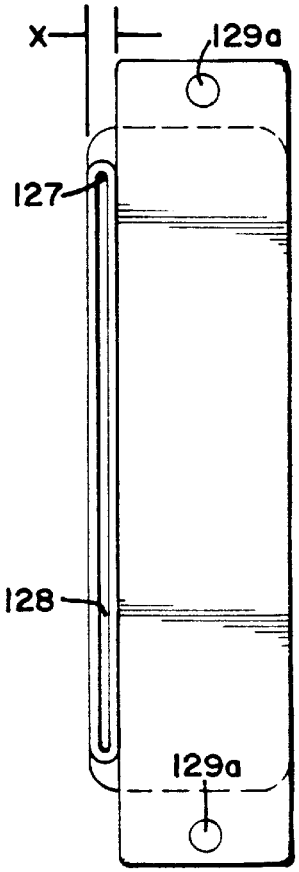
FIG. 10

DISPENSER

This is a Divisional of application Ser. No. 08/644,620, filed May 6, 1996, now U.S. Pat. No. 5,782,109 which application is incorporated herein by reference.

BACKGROUND OF THE INVENTION

1. Field of the Invention

This invention relates generally to a chemical dispenser for washing operation and in more particular to a chemical dispenser which utilizes a pop out chemical product package, a low level indicator, a temperature compensating controller to vary a dispenser's dispensing time in response to the temperature of the dilutant.

2. Description of the Prior Art

The use of dispensers to dispense a solid product by use of water or other diluents are well known in the art. Such dispensers may be used for many purposes, one of which is to provide detergent and/or bleach for washing operations. Problems arise when it is necessary for the operator to physically handle or touch certain chemicals, such as bleach. Usually, the package in which the bleach is contained must be inverted in order to place the bleach into a dispenser. Such a manipulation of the bleach presents a problem in keeping the bleach inside of the package while positioning the package over the appropriate receptacle in the dispenser. The present invention addresses such a problem and provides for a pop out container for containing bleach, or other similar products which are dangerous to handle, and utilizes a release mechanism on the dispenser to allow the bleach to be released and placed into the dispenser.

Once a dispenser has been activated and a use dilution is available, it must then be conducted from the dispenser to a suitable place for use. When such a dispenser is used with a washing machine, the most widely accepted method of connecting the outlet conduit to the washing machine is to cut a hole in the sheet metal housing or the hinged cover. A fitting is then installed and the tubing is connected to the fitting. Also, fittings may be added by cutting into or disassembling the plumbing and/or cutting into the outer drum of the machine. These methods have negative consequences such as corrosion, interference with operation of the hinge cover, snagging of laundry, and internal liquid leakage. The present invention addresses this problem in the prior art and provides for a chemical injection manifold which may be easily secured to the washing machine and utilizes the gap formed between the washing machine and hinged lid.

One additional problem that is associated with dispensers which need to be refilled is to alert the operator that the chemical product level is low and needs refilling. There are many sophisticated and expensive systems to accomplish this task. They include photoelectric devices which use a light source directed on to a photoelectric sensor that control an electrical signal that turns on an audio or visual alarm, thereby alerting the user. Other simpler devices have been used such as simply shining a light through the interior of the dispenser and then, when the product level falls, the scattered rays of the light can be seen through a viewing window. However, such systems are not as effective as the operator has a difficult time seeing the light shine through the view port. Applicant has addressed the problems associated with prior art devices and have provided for and simple, low cost means to alert the operator to refill the chemical in the dispenser by utilizing a high intensity, focused lamp.

Another problem found in solid chemical dispensers, as well as other dispensers as a whole, is that of accurately controlling the amount of chemical product dispensed. For example, some solid chemical dispensers control the amount of product dispensed by monitoring the concentration of chemical product in a use dilution with a conductivity sensor. Such sensors, however, are expensive and complex, and may not be cost effect for use in certain low cost applications.

As an example, in some laundry applications, it may not be cost effective to utilize a conductivity sensor. In these applications, therefore, a low cost dispenser is often used which delivers a predetermined amount of chemical product by assuming a constant delivery rate and operating the dispenser for a fixed period of time. However, it has been found that in the field it is difficult or impossible to control many of the operating parameters that may alter the actual dispensing rate of the dispenser. When the actual dispensing rate of the dispenser changes in operation, the total amount of chemical product delivered changes accordingly. Particularly in many laundry applications, if the actual product dose delivered by a dispenser is low, cleaning and overall performance is reduced. If the actual product dose is high, excessive sudsing can occur and chemical costs may increase.

One particular operating parameter that can affect dispensing rates is the temperature of the diluent. Particularly in solid chemical dispensers where diluent impacts a solid chemical and dissolves the chemical to form a use dilution, it has been found that the temperature of the diluent significantly impacts the dispensing rate of chemical product. Short of precisely controlling the temperature of the diluent, which is difficult if not impossible to do in the field, there is no reliable manner of controlling the total amount of product dispensed with a fixed time dispenser. The present invention addresses this problem in the prior art and provides for a dispensing apparatus and method in which a dispensing time of a dispenser is dynamically varied in response to diluent temperature during operation of the dispenser.

SUMMARY OF THE INVENTION

In one embodiment, the invention is a chemical product injection manifold for use with a washing machine of the type having an opening in its top and a lid. The lid is sized to be smaller than the opening so as to form a gap between the top and the lid. The manifold includes a fitting adapted to receive a hose from a chemical dispenser. A housing, having an interior cavity, is in fluid communication with the fitting. The housing also has a bottom. Also provided is a means for positioning the manifold on the washing machine top proximate the gap between the top and the lid. The positioning means is operatively connected to the housing. An outlet is in fluid communication with a cavity. The outlet is generally elongate and has a width less than the width of the gap.

In another embodiment, the invention is a dispenser having a chemical product level indicator. The dispenser includes a housing having an inner cavity for storing chemical products to be dispensed. A focused light source is positioned on a wall of the housing at a location commensurate with a level of the chemical product to be detected. A view port is located on an opposite wall of the housing in general alignment with the focus light source, wherein the focused light is aimed at the view port. When the chemical product level is above a line between the view port and the light source, the light is blocked from the view port and when the chemical product is lowered, the focused light source shines on the view port and can easily be seen by an operator. In a preferred embodiment, the light source is a high intensity light emitting diode having a viewing angle of less than 6°, and preferably 4° and an intensity of above 10,000 mcd.

In another embodiment, the invention is a dispenser for dispensing a chemical product that is dissolved by diluent. The dispenser includes a housing for receiving a chemical product. The housing has an inner cavity, open top, and an outlet. Also provided is a means for spraying a diluent onto the solid material to dissolve the chemical product. A package supplies the chemical product to the dispenser. The package includes a container having an inner cavity and an open end including a peripheral wall defining an opening in the container. A diaphragm is mounted on the peripheral wall and traverses a portion of the opening. The diaphragm has a plurality of flexible members extending inward. The flexible members are made of a semi-rigid material and are sized to inhibit removal of the chemical product when in a first position. The flexible members are adapted to be displaced away from the center of the container to a second position, wherein the chemical product no longer inhibits the removal of the chemical product. A flange member is mounted on the housing proximate the open top. The flange member is sized and configured for moving the flexible members from a first position to a second position as a package is placed over the flange, wherein the chemical product may then fall from the container into the cavity of the housing.

In another embodiment, the invention is a dispensing apparatus and method in which a dispensing time of a dispenser is dynamically varied in response to diluent temperature during operation of the dispenser. By dynamically monitoring temperature and updating a dispensing time while the dispenser is operating, changes in the diluent temperature both between dispensing cycles and within individual dispensing cycles may be compensated for, thereby offering improved dispensing accuracy. A low cost temperature sensor such as a thermistor may be used to monitor diluent temperature at periodic intervals. A table or equation which relates the dispensing rate of the dispenser for a given product to diluent temperature may be accessed to determine an instantaneous dispensing rate at each interval, as well as a partial amount or dose representing the volume or dose of chemical product delivered during the interval at the instantaneous dispensing rate. The partial amount may be added with a running total of prior partial amounts, such that the overall amount or dose of product dispensed is maintained in the running total. The dispenser may be shut off when the running total reaches the desired amount or dose of product to be delivered.

Therefore, in accordance with one aspect of the invention, a dispensing apparatus is provided, which includes a dispenser, the dispenser receiving a diluent and outputting a use dilution comprising a chemical product diluted by the diluent, wherein a dispensing rate of chemical product for the dispenser varies with a temperature of the diluent; a temperature sensor sensing the temperature of the diluent and outputting a temperature signal representative thereof; and a controller, coupled to the dispenser and the temperature sensor, the controller operating the dispenser to dispense an amount of use dilution having a predetermined amount of chemical product, wherein the controller dynamically varies a dispensing time of the dispenser while the dispenser is dispensing use dilution in response to the temperature signal to deliver the predetermined amount of chemical product.

In accordance with another aspect of the invention, there is provided a method of dispensing a predetermined amount of chemical product in a dispenser of the type which dilutes the chemical product in a diluent and outputs the same as a use dilution, and which has a dispensing rate for the chemical product which varies with the temperature of the diluent. The method includes the steps of initiating output of use dilution from the dispenser; monitoring the temperature of the diluent as the dispenser outputs use dilution; calculating a running total of chemical product dispensed from the dispenser using the temperature of the diluent; and halting output of use dilution from the dispenser when the running total equals the predetermined amount.

BRIEF DESCRIPTION OF THE DRAWINGS

FIG. 4 is a perspective view of the bleach housing of the dispenser shown in FIG. 1.

FIG. 5 is a top plan view of the package used for supplying chemical products.

FIG. 7 is an exploded perspective view of the package for supplying bleach.

FIG. 8 is a perspective view of the injection manifold shown in FIG. 1.

FIG. 9 is a cross-sectional view of the injection manifold on a washing machine.

FIG. 10 is a bottom plan view of the injection manifold shown in FIG. 8.

DETAILED DESCRIPTION OF A PREFERRED EMBODIMENT

Figure 1:
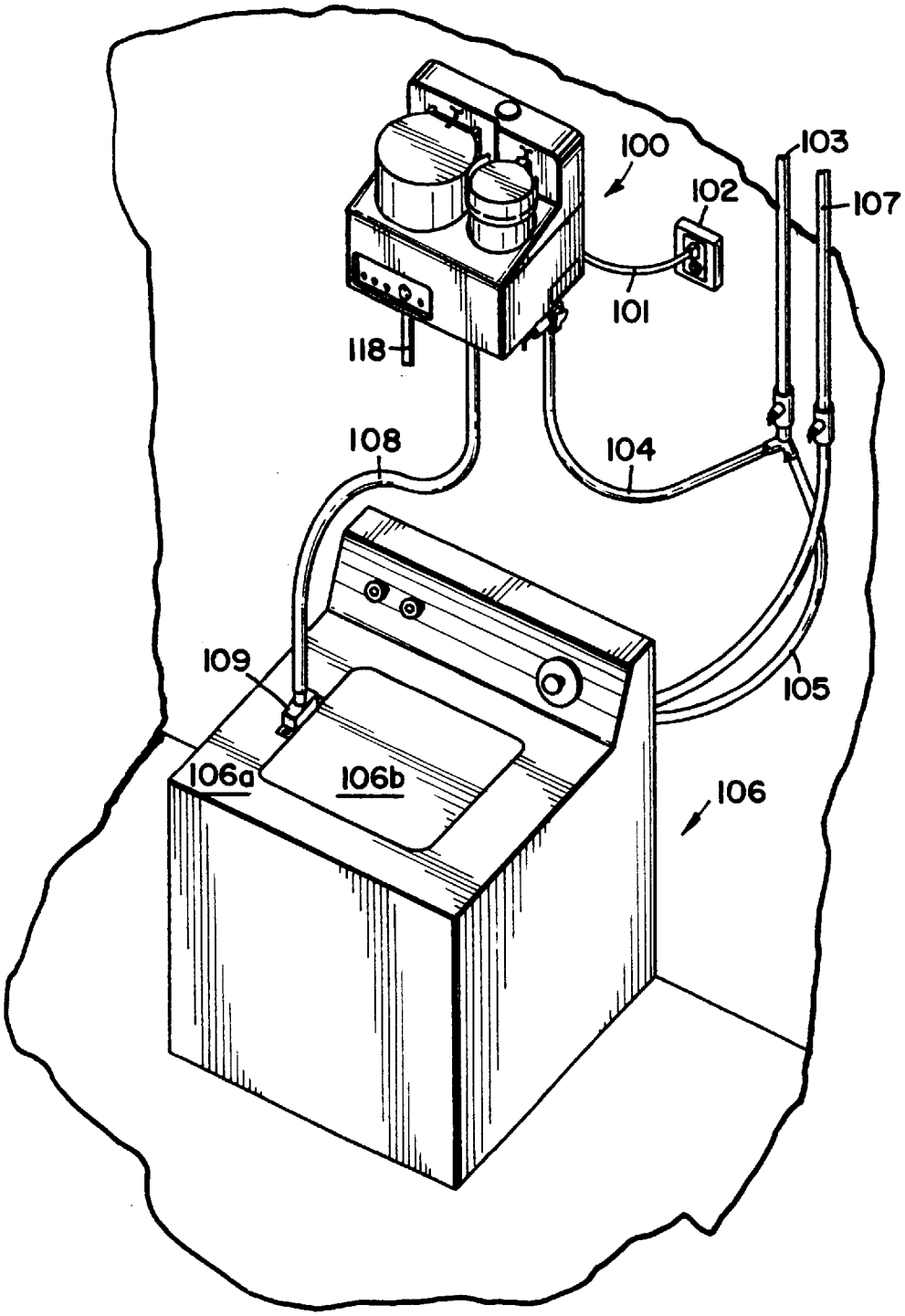
FIG. 1 is a perspective view of the dispenser of the present invention in use with a washing machine.

Referring to the drawing, wherein like numerals represent like parts throughout several views, there is generally disclosed at 100 a dispenser. Electrical power is provided to the dispenser 100 by a power cord 101 which is connected to a suitable outlet 102. Hot water is provided to the dispenser 100 through a hot water pipe 103. The hot water pipe then has a Tee connector operatively attached thereto and a water inlet 104 is connected to the dispenser 100 and a second water inlet 105 is connected to the washing machine 106. Cold water is supplied through cold water pipe 107 to the washing machine 106. A use dilution outlet hose 108 connects the dispenser 100 to the injection manifold 109. The injection manifold 109 is mounted to the washing machine 106, as will be described in more detail hereafter. The washing machine 106 has a top 106*a* and a lid 106*b*. The lid 106*b* is typically hinged to the top 106*a*. In most washing machines there is an gap between the washing machine top 106*a* and the lid 106*b*, as will be described more fully hereafter.

Figure 2:
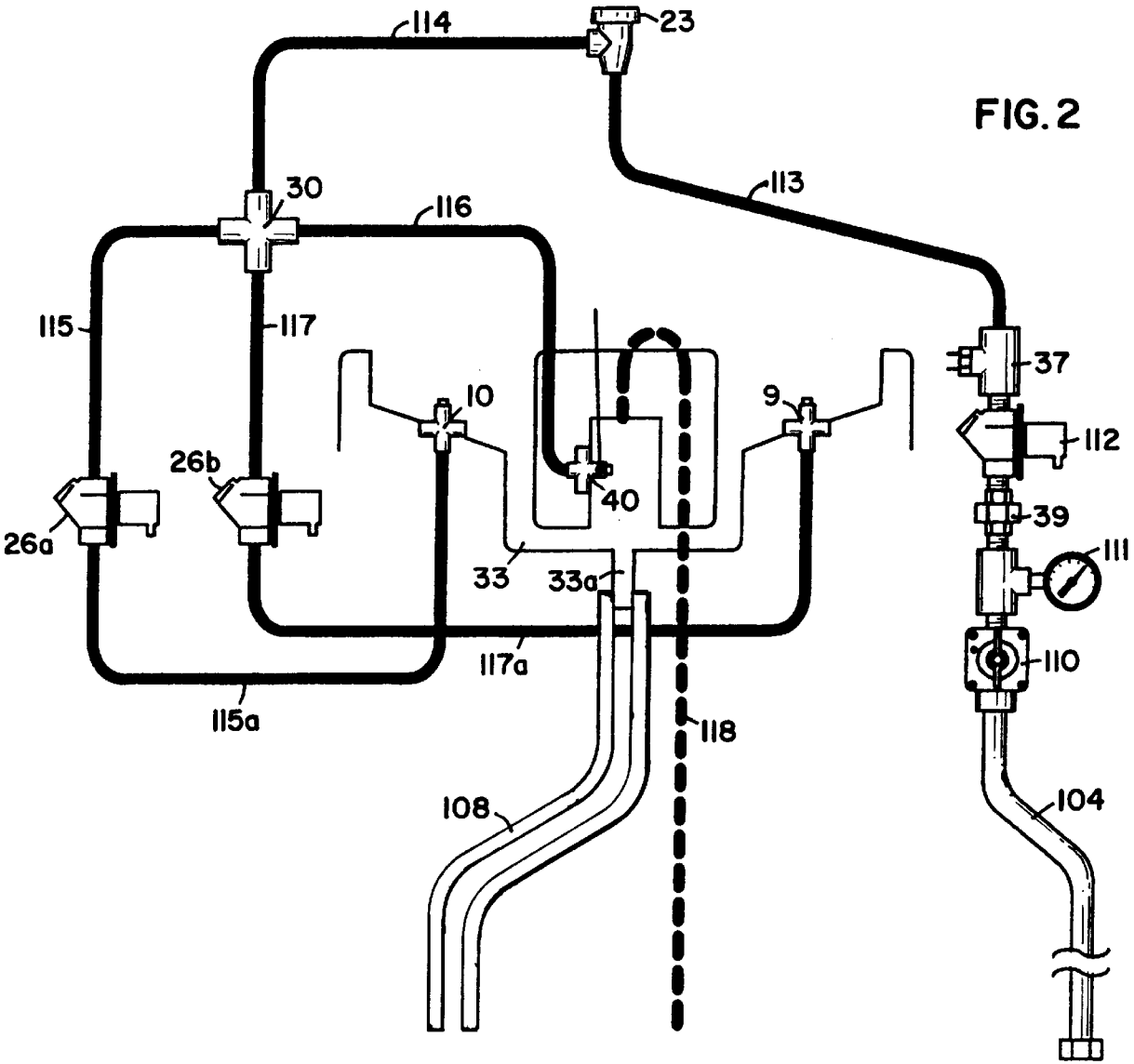
FIG. 2 is a diagrammatical sketch of the operation of a portion of the dispenser.

FIG. 2 provides an overall flow chart of the basics of how the dispenser 100 operates. The general operation of the dispenser will now be discussed followed by a more detail description of the construction of the dispenser 100.

The hot water inlet 105 provides hot water through a regulator 110 and pressure gauge 111. The main solenoid 112 is connected to the gauge 111. Further, a thermistor 37 is placed in fluid communication with the flow of the hot water through hose 113 to a vacuum breaker 23. The operation of the main solenoid valve 112 and thermistor 37 as they interact with the control processor 44 will be discussed more fully hereafter. On the other side of the vacuum breaker 23, a hose 114 is connected to a Tee 30. The Tee 30 has three outputs which are connected by means of tubing 115, 116, and 117. Tubing 115 provides for fluid communication of the hot water to the detergent valve 26*a*. Tubing 117 provides fluid communication of the hot water to bleach valve 26*b*. Tubing 116 provides fluid communication of the hot water to flush nozzle 40. The detergent nozzle 10 is in fluid communication with the detergent valve 26*a* by means of tubing 115*a*. Similarly, the bleach nozzle 9 is in fluid communication with the bleach valve 26*b* by tubing 117*a*. A sump 33 collects any of the use dilution or hot water which has been provided through the detergent nozzle 10, bleach nozzle 9, or flush nozzle 40 and the use dilution or hot water is transferred out of the sump 33 by means of gravity through use dilution outlet hose 108.

Referring to FIGS. 8 thru 10, the washing machine top 16*a* has a first generally planar horizontal surface 120 connected to a downwardly depending surface 121 connecting the second generally planar horizontal surface 122. The combination of these three surfaces form a ledge on which the washing machine lid 106*b* rests. As can be seen, there is a gap G between the surface 121 and the edge of the lid 106*b*. Further, there is a slightly smaller gap between the surface 122 and the bottom of lid 106*b*.

The injection manifold 109 has a housing which comprises a base 123 and a top 124. The base 123 has an open top. The top 124 is secured to the open top of the base 123, thereby defining an inner cavity 125. The base and top form an elongate manifold and generally forms a rectangular box. An inlet connector 126 is connected to the top 124 so as to allow fluid communication between the inner cavity 125 and the product outlet hose 108. The base 123 has an outlet 127. The outlet 127 has a generally elongate orifice 128 that is preferably at least 3 inches in length. The outlet 127 has a width X which is less than the width of the gap G. Typically, the width of the gap in most washing machine is at least 3/16 of an inch or 0.187 inches. By having the width X less than 0.18 inches, there is clearance for the lid 106*b* to close without hitting the manifold 109. Width X is approximately 0.165 inches. The width O of the orifice 128 is preferably between 0.05 to 0.06 inches to allow for sufficient use dilution to flow through the manifold.

The base 123 has a bottom 123*a* to which a generally elongate member 129 is secured. The manifold 109 needs to be positioned and held in place on the washing machine. FIG. 1 shows the manifold 109 on the washing machine top 106*a*. By positioning the manifold on the washing machine top, the manifold is not moved when the lid is moved to an open position. However, it is understood that the manifold could be positioned on the lid, although it would not be as advantageous. In order to position and secure the manifold 109 to the washing machine top 106*a*, the elongate member 129 is provided with two mounting holes 129*a* through which mounting screws may be inserted and screwed into the washing machine top 106*a*. It is understood that other suitable means of mounting the manifold may also be utilized. Preferably, the inlet 126, base 123, top 124, and outlet 127 are constructed from a rigid plastic and are assembled into an integral unit. The elongate member 129 extends beyond the base 123 so that the mounting holes 129*a* are readily accessible.

Figure 3:
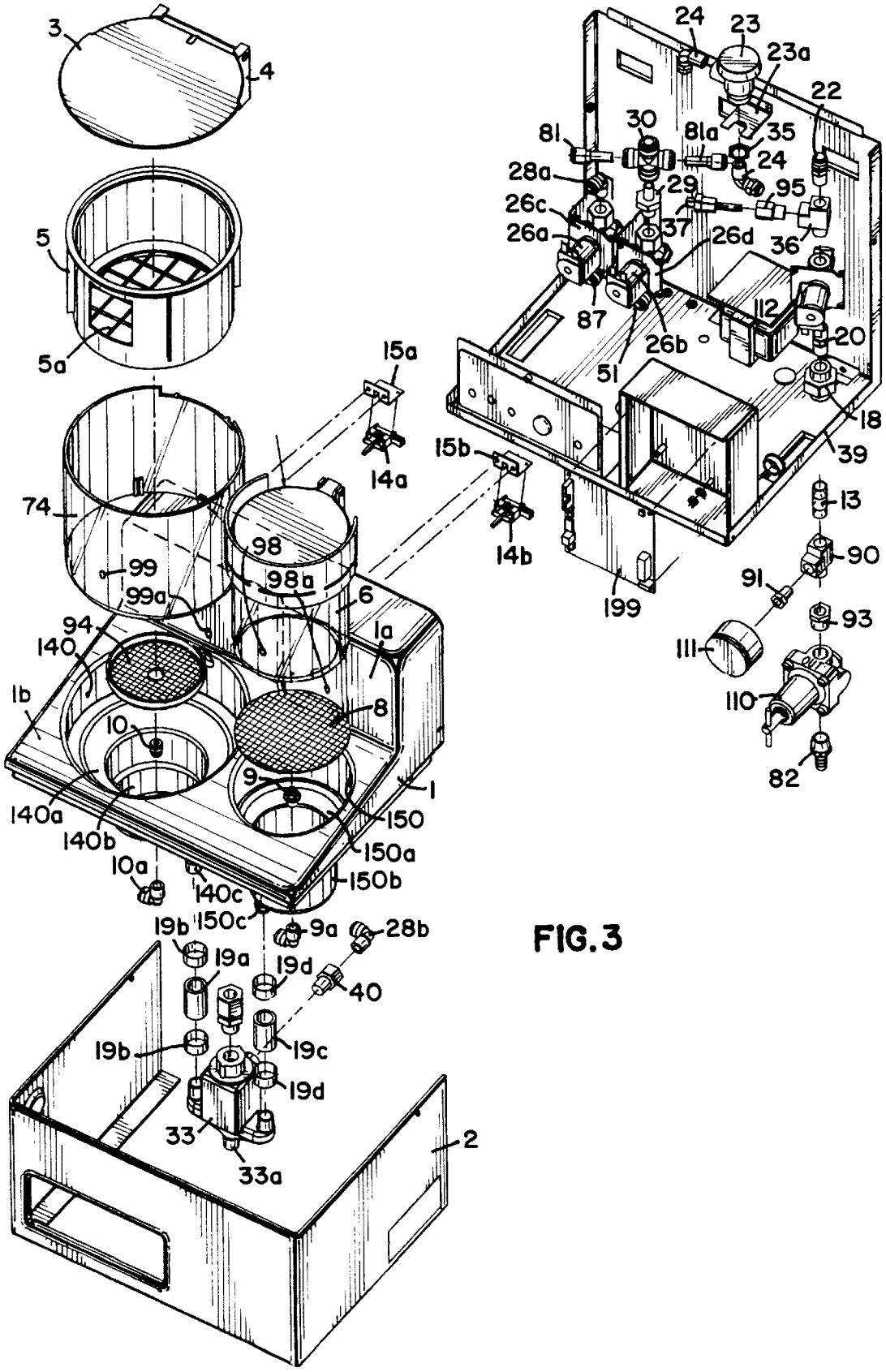
FIG. 3 is an exploded perspective view of a portion of the dispenser.

Referring to FIG. 3, there is shown an exploded perspective view of the dispenser. The exploded perspective view in FIG. 3 does not show the hose connections. For the connections, one should refer to FIG. 2. A hose adapter barb 82 receives the hot water inlet 105. The adapter 82 is inserted into the water pressure regulator 110, which is in turn connected to a Tee 90 by means of a bushing 93. A pressure gauge 111 is also connected to the Tee 90 by means of a bushing 91. A nipple 13 is also connected to the Tee 90. The nipple 13 is connected to a connector 18 which is mounted on the chassis weldment 39.

The housing for the dispenser includes an upper housing 1, lower housing 2, and chassis weldment 39. As can be seen in the exploded perspective, the chassis weldment 39 fits inside of the lower housing 2. The upper housing is then placed on top of the chassis weldment 39 and may later be secured in position by suitable means, such as screws.

A nipple 20 connects the connector 18 to the main solenoid valve 112. A Tee 36 is connected to the solenoid 112. A thermistor 37 is connected to the Tee 36 by means of a adapter 95. Connected to the top of the Tee 36 is a tube connector 22 to which hose 113 is connected to elbow 24. The elbow 24 is connected to the vacuum breaker 23 by means of a nut 35. The vacuum breaker 23 includes a bracket 23*a* so that the vacuum breaker 23 may be mounted to the chassis weldment 39. Another elbow 24 is connected to the vacuum breaker 23 and the hose 114 is connected to the elbow 24 at one end and at the other end of the hose 114 it is connected to the Tee 30. With the hose 114 providing a hot water inlet to the Tee 30, the Tee 30 has three outlets. The first outlet has a reducing coupler 81 connected to it. The hose 115 is then connected to the reducing coupler 81 at one end and to the detergent valve 26*a* through an elbow 28*a*. Another output of Tee 30 has an adapter 29 to which a first end of the hose 117 is connected. The second end of the hose 117 is connected to the bleach valve 26*b*. Both the detergent valve 26*a* and bleach valve 26*b* are mounted to the chassis weldments by way of brackets 26*c* and 26*d*. The third output of the Tee 30 has a connector 81*a* attached thereto. A first end of the hose 116 is connected to the connector 81*a* and the second end of the hose 116 is connected to an elbow 28*b* which is in turn connected to the spray nozzle 40. The spray nozzle is mounted into an inlet opening of the sump 33. Water entering the interior of sump 33 by way of the spray nozzle 40 exits thru the sump outlet 33*a*.

The upper housing 1 has a back panel 1*a* and a platform 1*b*. The platform 1*b* is generally planar as well a generally horizontal. However, there is a slight slope of the platform down towards the front of the dispenser. In the platform 1*b* are formed two circular receptacles. The first circular receptacle 140 is sized to receive a detergent reservoir cylinder 74. The detergent reservoir 74 is generally cylindrical. A detergent reservoir insert 5 which is also cylindrical is placed inside of the detergent reservoir 74. The detergent reservoir insert 5 has a mesh bottom 5*a*. A detergent cover 3 is connected to the detergent reservoir insert 5 by means of a hinge 4. The first circular receptacle 140 has a downwardly sloping surface 140*a* to act as a drain into the well 140*b*. Positioned between the well 140*b* and the mesh 5*a* is a detergent screen 94. The well 140*b* has an outlet 140*c*. The outlet 140*c* is connected to the sump 33 by tube 19*a*. Tube clamps 19*b* are used to connect the tube 19*a* to the outlet 140*c* and the sump 33.

The upper housing 1 has a second circular receptacle 150 which is sized to receive a bleach reservoir 6. The second circular receptacle 150 has a slope surface 150*a* draining down into a well 150*b*. The well 150*b* has an outlet 150*c* which is also connected to the sump 33 by a tube 19*c*. The tube 19*c* utilizes clamps 19*d* at both ends. A bleach screen 8 is positioned on top of the slope surface 150*a*, between the slope surface and the bleach reservoir 6. The bleach reservoir 6 will be discussed in more detail hereafter. Proximity reed switches 14*a* and 14*b* are mounted adjacent the covers of the detergent and bleach reservoirs by means of mounting brackets 15*a* and 15*b* respectively. The proximity reed switches are utilized to ensure that the covers are in a down position before the dispenser may operate.

A detergent spray nozzle 10 is mounted in the detergent reservoir 74 and extends through a central opening in the detergent screen 94. The nozzle is positioned to spray water onto the detergent which is stored in the detergent reservoir insert 5 on top of the mesh 5*a*. The nozzle 10 is connected to an elbow 10*a* which is connected to one end of hose 115*a*. The other end of the hose 115*a* is connected to elbow 87 which in turn is in fluid communication and connected to the detergent valve 26*a*. Similarly, a bleach spray nozzle 9 is mounted under the screen 8 and positioned to spray onto the bleach in the bleach reservoir 6, as will be more fully discussed hereafter. The bleach nozzle 9 is connected to elbow 9*a*. The elbow 9*a* is connected to one end of hose 117*a*. The other end of hose 117*a* is connected to elbow 51. The elbow 51 is in fluid communication and connected to the bleach valve 26*b*.

Referring to FIGS. 4–6 and 15, there is shown more detail the bleach reservoir and packaging. The bleach reservoir 6 has a cover 7 mounted to it by means of a hinge 7*a*. The bleach reservoir 6 is generally circular and has a cylindrical shape. At the top of the bleach reservoir 6 is a flange 6*a*. The flange is also circular and is preferably performed as an integral portion of the bleach reservoir 6. The flange member 6*a* defines the open top. The bleach reservoir 6 itself defines the inner cavity of the reservoir. The bleach reservoir has an outlet at its open bottom end which drains down the sloped surface 150*a*. An outer ring 160 is operatively connected to the bleach reservoir 6 proximate its open top. The ring 160 generally surrounds a portion of the flange 6*a*. Preferably, the ring is extends greater than 180° and preferably approximately 270°. The outer ring 160 is sized at a larger diameter than the flange 6*a*.

Figure 6:
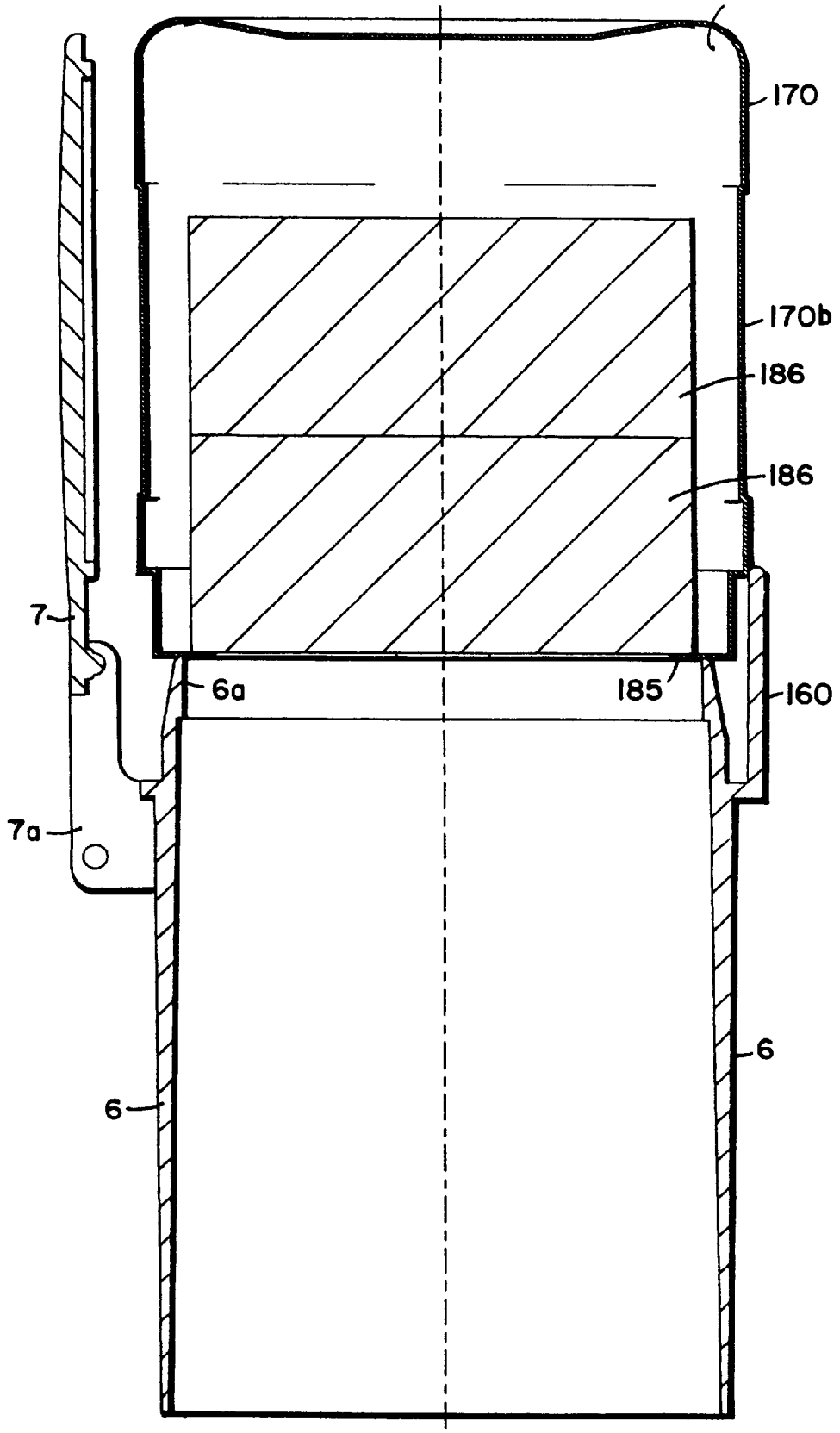
FIG. 6 is a cross sectional view of the bleach reservoir with the package about to be inserted.

The packaging 170 is generally a cylindrical container. The package 170 has an inner cavity 170*a* and peripheral walls 170*b*. The peripheral walls 170*b* are circular in shape and define an opening. A diaphragm, or fingered collar, 180 is mounted to the peripheral wall 170*b* and traverses a portion of the opening of the container. The diaphragm 180 has a plurality of flexible members, or flexible fingers, 185 that extend inwardly. The flexible members 185 are made of a semi-rigid material such as a suitable plastic. The bleach to be dispensed 186 is placed inside of the package 170. The bleach 186 is also cylindrical. The bleach is sized to have a smaller circumference than the flange 6*a*, but a larger circumference than the distance D between the ends of the flexible members 185. Thereby, the flexible members 185 support the bleach tablets 186 when the flexible members are in their normal first position. However, as previously stated, the members are flexible. That is, after the screw top 170*c* of the package is removed and the package inverted, the flexible members 185 retain the bleach within the container. Then, as the package is placed over the bleach reservoir, the outer ring 160 centers the package 170 over the flange 6*a*. As the package is pressed down, the flange 6*a* deflects the flexible members 185 upward and make the distance D' increase to a larger diameter when the flexible members are in their second position. As the flexible members are pushed upward, the bleach tablets 186 are also moved upward, until the flexible members are sufficiently deflected to allow the bleach 186 to fall down into the reservoir. This increased distance D' then is greater than the diameter of the bleach tablets and they thereby fall down into the bleach reservoir 6. The package is then removed and the lid 7 is closed. FIG. 6 shows a void between the bottom of the package 170 and the bleach. To prevent break-up of the bleach during shipment, it is preferred to add a foam packaging insert to fill this void. Alternately, the bottom of the package may be moved to make the height of the package less and more equivalent to the size of the bleach.

The package 170 has a plurality of ribs 170*d* that extend around its circumference. The ribs are longitudinal and assist in the handling of the package by allowing the package to be more easily gripped.

The dispenser 100 also has provided a low product alert feature. This low product alert consists of a view ports 98 and 99 formed in the bleach reservoir 6 and the detergent reservoir 74. Similarly, a light emitting diodes 98*a* and 99*a* are placed on the back portion of the upper housing 1. Since the alert systems are similar for both the bleach and detergent, the bleach alert will be described in more detail as it is understood that the principles of operation of the detergent alert are similar.

Figure 16:
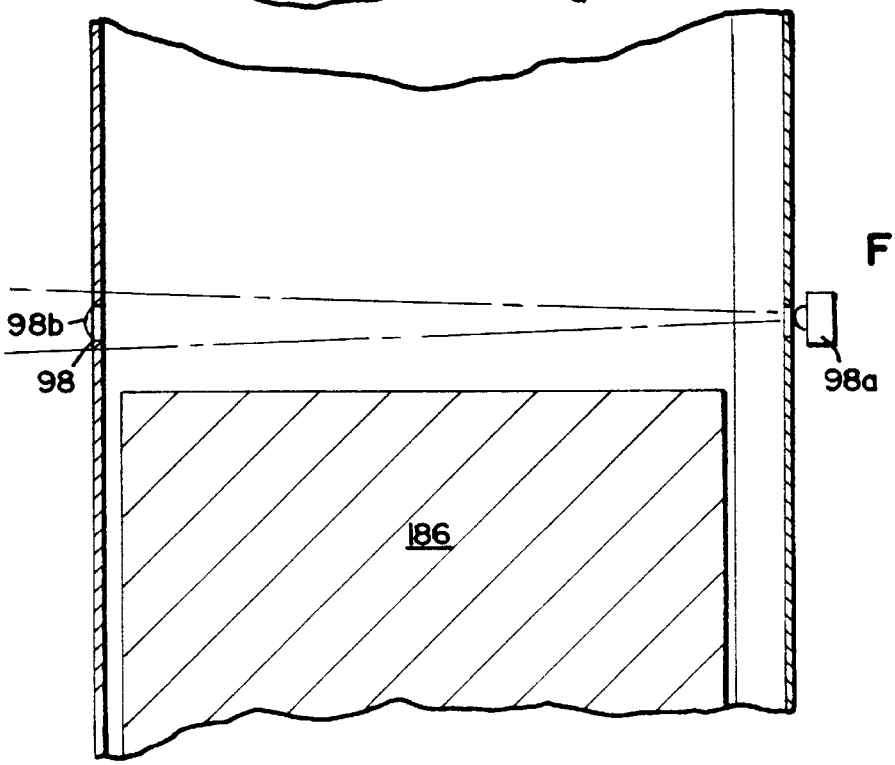
FIG. 16 is a view of the low level alert.

Referring to FIGS. 3 and 16, it can be seen that the focused light source 98*a* is mounted at a level where one wishes for the alert to be indicated. The higher one would mount the light source, the earlier the alert would be activated. In a preferred embodiment, the focused light source 98*a* is a light emitting diode having a viewing angle of 4°. Preferably, the angle would be at least less than 6° so as to utilize a focused beam of light. Further, the LED is preferably a high intensity LED and would have an intensity of at least 10,000 mcd and preferably 13,000 mcd. The focused beam of light shines through the wall of the bleach reservoir which is transparent. The light source is in general alignment with the view port 98 which is located on the opposite wall of the bleach reservoir. The view port can be either a single transparent section or opening or it could be a plurality of openings to allow for various placements of the light 98*a*. Further, the view port 98*a* may incorporate a diffuser 98*b* so that a focused beam of light from the LED 98*a* reaches the view port, the operator may more easily see the light shine through the view port. That is, if the view port is simply a transparent opening in the reservoir, the operator would tend to stand directly in alignment with the beam of light in order to see the beam of light. However, with the diffuser incorporated into the view port, the operator could stand off at an angle and see the light more easily.

The color of light could be any color, although it has been found that a red light will command the attention of the operator more easily. Further, as will be discussed more fully hereafter, the light may also flash to enhance the low level indication warning.

Figure 11:
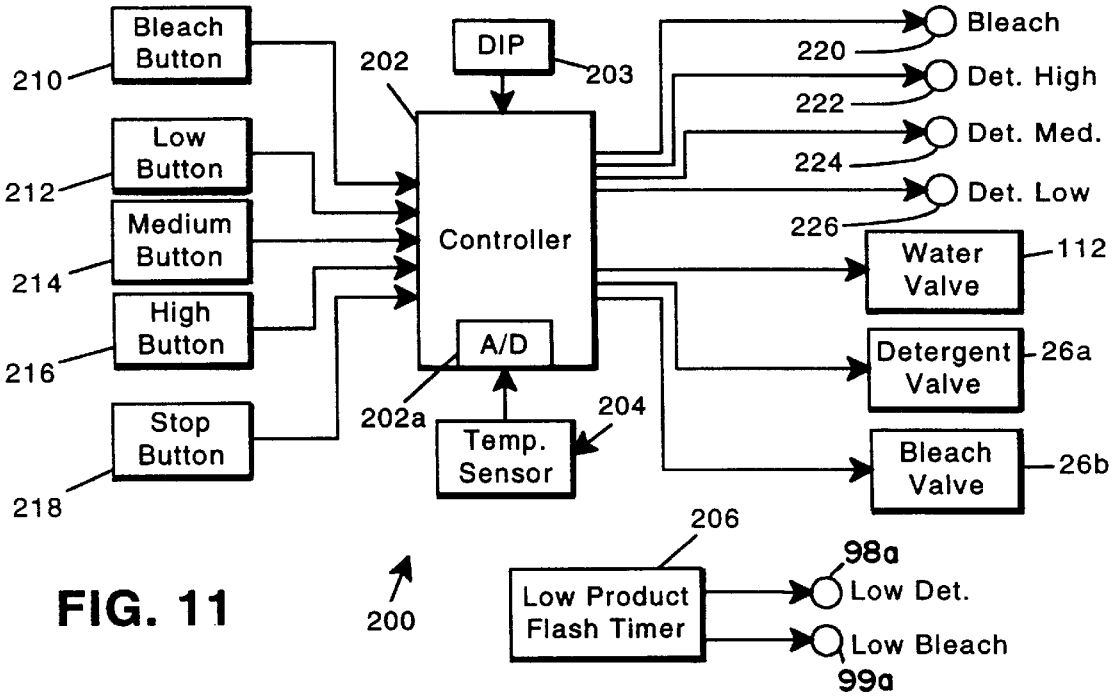
FIG. 11 is a block diagram of the preferred control system used in the dispenser of FIG. 2.

The principal hardware components for control system 200 are illustrated in FIG. 11. Control system 200 includes a controller 202 which coordinates primary operation of the system. Controller 202 is preferably a microprocessor or microcontroller, e.g., a Motorola MC68HC05 microcontroller or a MicroChip PIC 16C7X microprocessor, which incorporates a built-in analog-to-digital converter 202*a* for receiving an analog temperature signal from a temperature sensor 204. A/D converter 202*a* may be implemented in a separate component if desired.

Temperature sensor 204 preferably includes a low cost device such as thermistor 37 (FIG. 2), coupled to A/D converter 202*a* through a voltage divider circuit, for measuring diluent (water) temperature. Other manners of reading the thermistor, e.g., using a voltage sensitive timing circuit to provide a variable width pulse to the controller, may also be used.

As shown in FIG. 2, the thermistor measures the diluent temperature as it enters the dispenser. The thermistor may measure diluent temperature at other points in the dispenser, and may instead measure the use dilution temperature, or another temperature which affects the dispensing rate of the dispenser.

Temperature sensing devices other than thermistors may be used in the alternative. However, it has been found that thermistors are in general inexpensive and simple to control, and thus well suited for use in many low cost applications.

Controller 202 also receives several inputs from a plurality of buttons disposed on front panel 199 (FIG. 3). A bleach button 210 enables an operator to select whether bleach is to be dispensed along with detergent. Low, medium, and high detergent buttons 212, 214 and 216 enable an operator to select one of three amounts or doses of product to deliver. A stop button 218 enables an operator to immediately reset the dispenser and halt any further dispensing in the cycle. Buttons 210–218 are preferably momentary push buttons. In the alternative, the buttons may be replaced by other input devices, e.g., a switch for selecting bleach or no bleach, or a three way switch or dial for selecting output amount and a separate button for starting the dispensing cycle. Other input configurations may be used in the alternative.

Controller 202 also receives configuration information from a set of DIP switches 203. These switches are preferably located within the housing to restrict access to unauthorized users.

Controller 202 also controls different devices. A series of light emitting diodes (LEDs), bleach LED 220, detergent high LED 222, detergent medium LED 224 and detergent low LED 226, may be controlled to indicate when particular cycles are in progress. The LEDs may be separate of buttons 210–216, or may be incorporated into the buttons themselves. Controller 202 also controls water valve 112, detergent valve 26*a* and bleach valve 26*b* (FIG. 2) using a series of relays (not shown).

FIG. 11 also illustrates the flashing circuit, low product flash timer 206, for flashing the low detergent and low bleach alarm LEDs 98*a* and 99*a* in the manner discussed above. Timer 206 preferably includes a 555 series timer circuit that flashes LEDs 98*a* and 99*a* at ½ second intervals continuously while power is supplied to the dispenser. The use of a timer to flash LEDs or other light emitting devices is in general well understood in the art, and will not be discussed further herein. In the alternative, controller 202 may be used to control LEDs 98*a* and 99*a*, e.g., to flash the LEDs only during product dispensing, if desired.

Other support circuitry, including RAMs, ROMs, clock oscillator circuits, power supply circuits, buffers, drivers, etc. may be required to configure controller 202 to operate the dispenser. However, as such support circuitry will typically vary depending upon the type of processor, and as the use of such support circuitry is well understood in the art, no further discussion thereof is provided herein.

Figure 12:
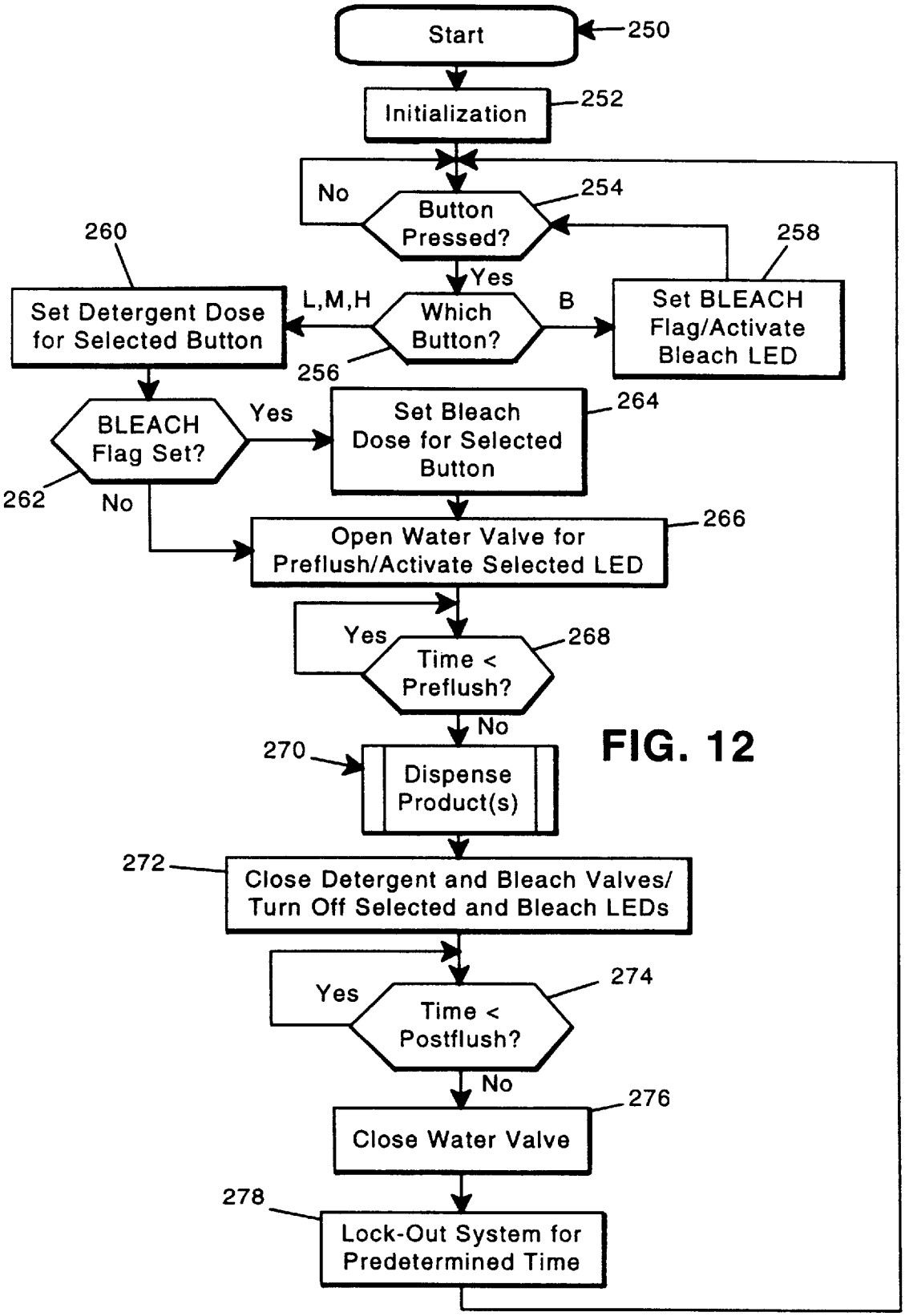
FIG. 12 is a flowchart illustrating the preferred program flow of a the dispenser of FIG. 2.

The preferred operation of dispenser 100 is illustrated by the preferred program flow of the operating code executed by controller 202, shown as main routine 250 in FIG. 12. Routine 250 begins upon startup at block 252 by performing several initialization functions, including resetting variables and counters, defining constants, and other housekeeping functions. At this time, several user-selected options, preferably controlled via a series of DIP switches 203 (FIG. 11) located within the housing of dispenser 100, may also be processed.

In the preferred embodiment, eight DIP switches (illustrated by block 203 in FIG. 11) are used to program or customize the dispenser for different situations. The available settings of the DIP switches are illustrated below in Table I:

TABLE I

| | DIP Switch Settings | | | | | |
|---|---|---|---|---|---|---|
| Switch | Setting | | | Low | Medium | High |
| Detergent Dose (Grams) | | | | | | |
| 1 2 3 | off | off | off | 10 | 20 | 25 |
| | on | off | off | 15 | 30 | 37.5 |
| | off | on | off | 20 | 40 | 50 |
| | on | on | off | 25 | 50 | 62.5 |
| | off | off | on | 30 | 60 | 75 |
| | on | off | on | 35 | 70 | 87.5 |
| | off | on | on | 40 | 80 | 100 |
| | on | on | on | 50 | 100 | 125 |
| Bleach Dose (Grams) | | | | Chlorine | | |
| 4 5 6 | off | off | off | 3 | 6 | 7.5 |
| | on | off | off | 4 | 8 | 10 |
| | off | on | off | 5 | 10 | 12.5 |
| | on | on | off | 6 | 12 | 15 |
| | off | off | on | 8 | 16 | 20 |
| | on | off | on | 10 | 20 | 25 |
| | off | on | on | 12 | 24 | 30 |
| | on | on | on | 14 | 28 | 35 |
| | off | off | off | 7.5 | 15 | 18.75 |
| | on | off | off | 12.5 | 25 | 31.25 |
| | off | on | off | 17.5 | 35 | 43.75 |
| | on | on | off | 22.5 | 45 | 56.25 |
| | off | off | on | 27.5 | 55 | 68.75 |
| | on | off | on | 32.5 | 65 | 81.25 |
| | off | on | on | 37.5 | 75 | 93.75 |
| | on | on | on | 50 | 100 | 125 |
| Bleach Product Type | | | | | | |
| 7 | off | | | Chlorine | | |
| | on | | | Oxygen | | |
| Lock-out | | | | | | |
| 8 | off | | | No Lock-out | | |
| | on | | | 5 Minute Lock-out | | |

In the preferred embodiment, the low dose is set to 50% of the medium dose, while the high dose is set to 125% of the medium dose. Thus, in block 252, the DIP switches are polled to obtain, first, the type of bleach used (chlorine or oxygen), and second, the medium dosages or dispensing amounts (in grams) for the detergent and the selected bleach. It should be appreciated that multiple product types, and multiple dispensing amounts for each product type, may be supported, although in some applications, this may not be required. Alternative to DIP switches, the product types and dispensing amounts may be controlled via front panel selections or in other manners known in the art.

Also, in block 252 the lockout DIP switch may also be polled to set or clear a lockout flag, which is set whenever it is desired to limit the dispenser use to once per five minutes so that only one dose of detergent and bleach may be provided to the machine for each cycle.

The main program loop of routine 250 is next executed starting at block 254, where the routine waits until a button is pressed by an operator. Block 254 may include a debounce routine, known in the art, to ensure the validity of any button activations (e.g., requiring an operator to push a button for one full second).

Once a button depression is detected, control passes to block 256 to determine which button was pressed. If bleach button 210 is pressed, control passes to block 258 to set a BLEACH flag to TRUE, and to activate Bleach LED 220 to indicate to an operator that the bleach function is selected. Block 258 may also simply toggle the BLEACH flag and LED with each button depression, so that an operator may change his or her mind after selecting the bleach function. In either event, control next returns to block 254 to wait for another button depression.

Returning to block 256, if any of low, medium, and high detergent buttons 212, 214 or 216 is pressed, control passes to block 260 to initiate the cycle. Block 260 sets the desired dose or amount of detergent to dispense (Detergent Dose) by scaling the medium detergent dose obtained above in block 252 by the low, medium or high scaling factors (50%, 100% or 125%), depending upon which button was pressed. Next, in block 262, if the BLEACH flag is set, the desired dose or amount of bleach to dispense (Bleach Dose) is set in block 264 by scaling the medium bleach dose in the same manner as outlined above in block 252. While the scaling factors are preferably the same for detergent and bleach, they may be different from one another. Moreover, one or both of the detergent and bleach may not be scalable in the alternative, or separate level selections may be made for each product independently.

After block 264, or if the BLEACH flag was not set, control passes to block 266 to initiate a preflush cycle. In this block, water valve 112 is opened and the LED corresponding to which button was depressed (i.e., detergent low LED 226, detergent medium LED 224 or detergent high LED 222) is activated. As shown in FIG. 2, since valves 26*a* and 26*b* are closed, opening of valve 112 directs water through thermistor 37, vacuum breaker 23 and lines 113, 114 and 116, where the water exits nozzle 28*c* and collects in sump 33 for outlet through outlet 108 to machine 106.

Returning to FIG. 12, block 268 next waits until the preflush time has been reached (preferably about 30 seconds). The primary purpose of the preflush is to wet the clothing in the machine to prevent damage as a result of high chemical concentrations, and to flush out any cold water from the water supply so that the water received by the dispenser at the end of the preflush cycle is at normal operating temperature.

Figure 13:
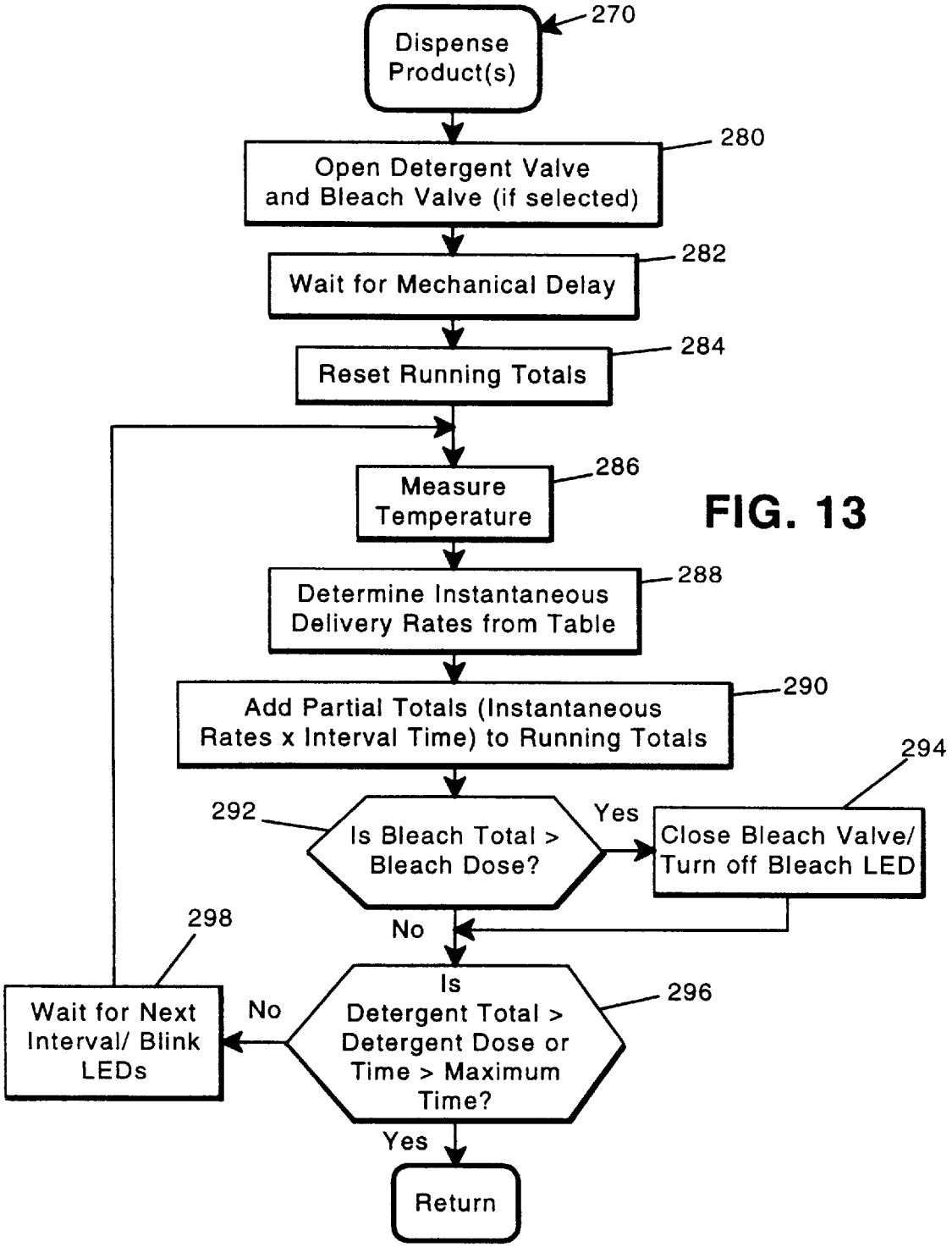
FIG. 13 is a flowchart illustrating the preferred program flow for the Dispense Product(s) routine of FIG. 12.
Figure 15:
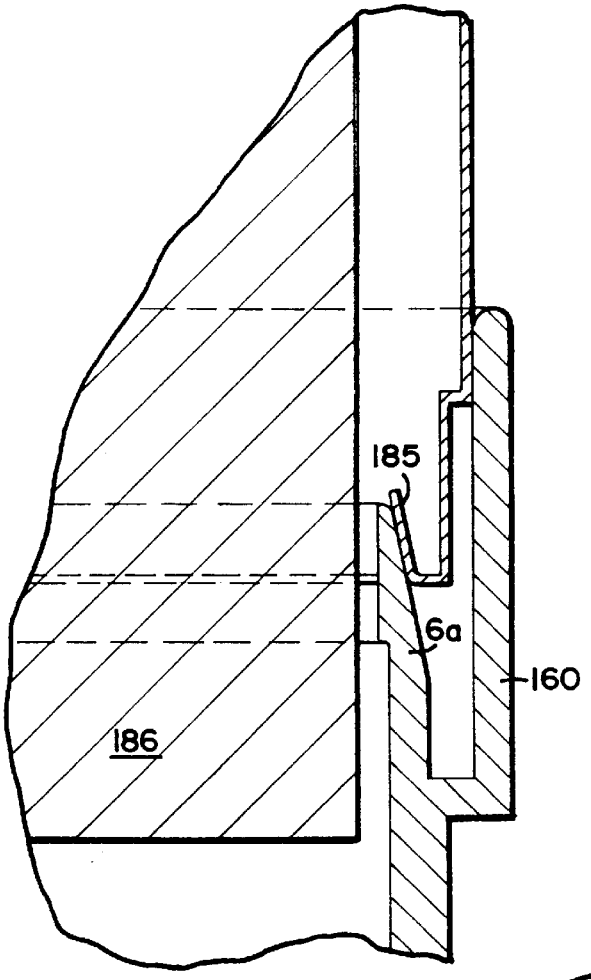
FIG. 15 is an enlarged fragmentary view of a portion of the bleach reservoir, showing the flexible members pushed upward.

Next, a Dispense Product(s) routine 270 is executed to dispense the desired dose of detergent (and if selected) the desired dose of bleach. Routine 270 is illustrated in greater detail in FIG. 13, and begins in block 280 by opening detergent valve 26*a*, and if the BLEACH flag is set, opening bleach valve 26*b*. As shown in FIG. 2, opening of valve 26*a* diverts a portion of the water in line 114 to line 115 and out of nozzle 28*a* where it sprays on the solid detergent concentrate to form a detergent use dilution therefrom. The use dilution then collects in sump 33, mixes with the water exiting nozzle 28*c*, and is communicated to machine 106 through outlet 108. Similarly, opening of valve 26*b* diverts a portion of water in line 114 to line 117 and out of nozzle 28*b* where it sprays form a solid bleach concentrate to form a bleach use dilution therefrom, which also collects in sump 33, mixes with the water from nozzle 28*c* and the detergent use dilution from nozzle 28*a*, and is communicated to machine 106 through outlet 108. It should be appreciated that the liquid communicated through outlet 108 forms the final use dilution for the dispenser from any liquids exiting nozzles 28*a*, 28*b* and 28*c* and collecting in the sump.

Returning to FIG. 13, block 282 next waits a predetermined period (preferably about two seconds) before beginning the calculation of the running totals of the amount of detergent and bleach dispensed. The delay represents the mechanical delay associated with the time between when valves 26*a* and 26*b* are opened and when water travels through lines 115 and 116, exits nozzles 28*a* and 28*b*, and begins to impinge the concentrates and form use dilutions therewith.

Next, in block 284, the running totals for the detergent and bleach are reset. Next, in block 286, the current temperature of the water is measured using thermistor 37. The thermistor is typically read by capturing the output voltage thereof with A/D converter 202*a* and reading the digital value obtained thereby.

Figure 14:
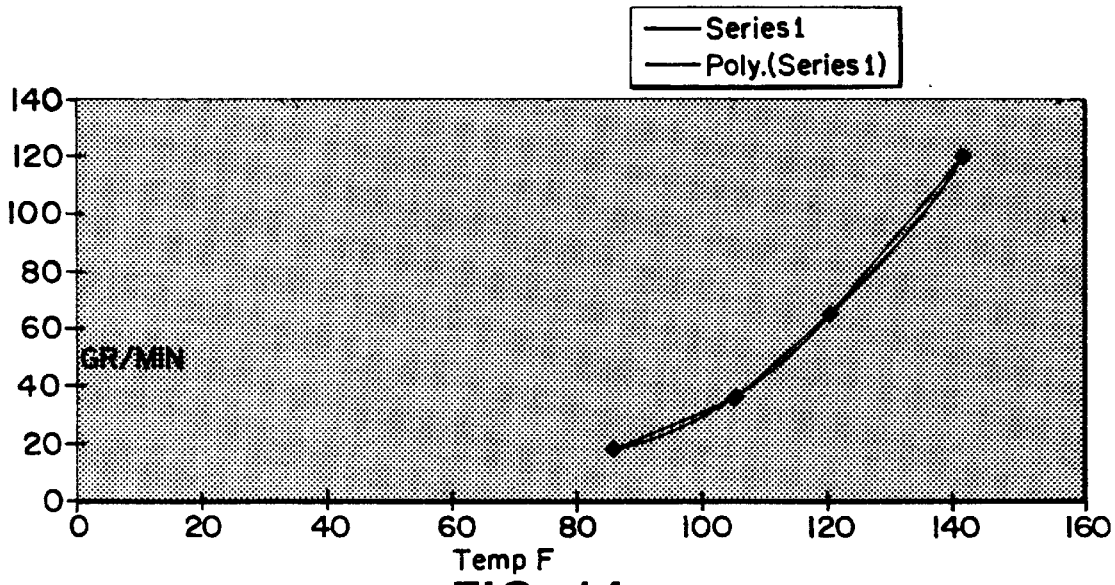
FIG. 14 is a graph of a typical dispensing rate v. diluent temperature curve.

Once the temperature of the water is obtained, instantaneous delivery or dispensing rates for detergent and bleach are obtained from tables stored in controller 202 which relate dispensing rates for particular products to temperature. The tables are preferably empirically determined for a given dispenser and product. As an example, FIG. 14 illustrates a characteristic dispensing rate curve for one chemical product, metasilicate hydrate, a solid block laundry detergent in the preferred detergent dispenser over a temperature range of about 80° to 140° F. The table may include any number of data points necessary to reproduce the curve, and dispensing rates for temperatures between data points may be interpolated, or the closest data point may be selected in the alternative. In addition, an equation may be developed, e.g., through curve fitting or other mathematical analysis, which relates temperature to dispensing rates, such that the measured temperature is simply plugged in an appropriate equation to obtain the instantaneous dispensing rate.

Returning to FIG. 13, after determination of instantaneous delivery rates, partial amounts or totals are calculated in block 290 by multiplying the instantaneous delivery rates by the time between temperature measurements (interval time), which is preferably about 0.25 seconds in the preferred embodiment. The partial amounts are then added to the running totals (detergent total and bleach total). It has been found that water temperature does not vary significantly in short time intervals, and thus substantially shorter interval times may only provide incremental improvements in response. In other applications, different interval times may be used in the alternative.

consequently, the operation of blocks 286–290 may be summarized generally by the equations:

$$DT=DT+IT^{*}\text{DetergentTable(Temp)}$$

$$BT=BT+IT^{*}\text{BleachTable(Temp)}$$

where DT and BT are detergent total and bleach total, IT is interval time, Temp is measured temperature, and DetergentTable(Temp) and BleachTable(Temp) are the instantaneous delivery rates retrieved from the detergent and bleach tables for the given measured temperature.

Next, in block 292, the bleach total is compared to the bleach dose to determine if the desired amount of bleach has been dispensed. If so, control passes to block 294 to close bleach valve 26*b* and turn off bleach LED 220.

Next, in block 296, the detergent total is compared to the detergent dose to determine if the desired amount of detergent has been dispensed. If so, the routine is complete, and control returns to block 272 in FIG. 12. If not, control passes to block 298 to wait until the next temperature measurement interval occurs. Also, during this time, the detergent LED (222, 224 or 226) corresponding to the button pushed (low, medium, or high), as well as the bleach LED 220 (if selected) are blinked to alert the operator that product is being dispensed. Control then returns to block 286 to handle the next temperature measurement.

Block 296 also tests if a maximum dispensing time (preferably about 120 seconds) has occurred. If so, control is returned to block 272 of FIG. 12, to ensure that the dispenser always shuts off after a predetermined time. It should be noted that in the preferred embodiment, the time needed to dispense the detergent dose typically exceeds that to dispense the bleach dose. In the alternative, if either the bleach or detergent could take longer to dispense, blocks 292 and 296 may be modified to ensure that each valve is closed at the proper time regardless of which is dispensed first.

Returning to block 272 of FIG. 12, upon completion of product dispensing, both valves 26*a* and 26*b* are closed and their respective LEDs are shut off. Next, a post flush cycle is initiated in block 274 where only water is sprayed out of nozzle 28*c* (typically about 10 seconds) to wash out any chemical residue within sump 33 or outlet 108.

Upon completion of the post flush cycle, control passes to block 276 to close water valve 112 and complete the dispensing cycle. Next, control passes to block 278 to lock the system out (preferably about five minutes) if this option is set in DIP switches 203. If the lock-out period has expired, or if the option is not selected, control returns to block 254 to wait for a new button depression.

Several other processes may be implemented on controller 202 consistent with the invention. For example, depression of stop button 218 (FIG. 11) is preferably handled by an interrupt-driven routine (not shown) to immediately close all valves and halt the system. Also, a separate programming process may be implemented so that field technicians may program or update the controller. Moreover, the controller may perform datalogging and record keeping, e.g., keeping track of how many cycles have been executed for each product. Other processes may be implemented in the alternative.

Various modifications may be made to the preferred dispenser consistent with the invention. For example, sampling of diluent temperature need not be performed at periodic intervals. Moreover, operating parameters other than diluent temperature may be monitored and compensated for by the preferred embodiments. Other types of dispensers e.g., those which mix liquid concentrates with diluent, may also utilize the principles of the invention. In addition, other applications may utilize the principles of the invention, e.g., chemical delivery systems where a chemical product is delivered without being mixed with a diluent, and where the viscosity of the chemical product, as well as its delivery rate, varies with its temperature. Other modifications will be apparent to one skilled in the art.

What is claimed is:

1. A dispenser for dispensing a chemical product that is dissolved by a diluent, comprising:

(a) a housing for receiving a solid chemical product material, said housing having an inner cavity, open top and an outlet;

(b) means for spraying a diluent onto the solid material to dissolve the chemical product;

(c) a package for supplying the chemical product, said package comprising:

(i) a container having an inner cavity and an open end including a peripheral wall defining an opening into the container;

(ii) a diaphragm mounted to the peripheral wall and traversing a portion of the opening, the diaphragm having a plurality of flexible members extending inward;

(iii) said flexible members being made of a semi-rigid material and sized to inhibit removal of the chemical product when in a first position; and (iv) said flexible members adapted to be displaced away from the center of the container to a second position, wherein the flexible members no longer inhibit removal of the chemical product; and (d) a flange member mounted on the housing proximate the open top, said flange member sized and configured for moving the flexible members from the first position to the second position as the package is placed over the flange, wherein the chemical product may then fall from the container into the cavity of the housing.

2. The dispenser of claim 1, wherein the package is an integral portion of the dispenser when inserted on the flange.

3. The dispenser of claim 1 wherein the package is generally cylindrical.

4. The dispenser of claim 3, wherein said package has ribs formed in its outer surface for easier handling.

5. The dispenser of claim 3, wherein said flange is circular and further comprises an outer arcuate ring, the outer ring mounted on said flange and generally surrounds a portion of said flange and sized larger than the package so as to guide the package in position over the flange.

6. The dispenser of claim 1, further comprising a chemical product injection manifold for use with a washing machine of the type having an opening in its top and a lid, the lid being sized to be smaller than the opening so as to form gap between the top and the lid, said manifold comprising:

(a) a fitting adapted to receive a hose from the dispenser;

(b) a housing having an inner cavity, said cavity in fluid communication with said fitting, said housing having a bottom;

(c) means for positioning said manifold on the washing machine top proximate the gap between the top and lid, said positioning means operatively connected to said housing; and (d) an outlet in fluid communication with said cavity, said outlet generally elongate and having a width less than the width of the gap.

7. The dispenser of claim 1, further comprising a chemical product level indicator, comprising:

(a) a focused light source positioned on a wall of said dispenser housing at a location commensurate with a level of solid material to be detected; and (b) a view port located on an opposite wall of said dispenser housing, in general alignment with said focused light source, wherein said focused light is aimed at said view port and when chemical product level is above a line between the view port and the light source, the light is blocked from the view port and when chemical product level is lowered, the focused light source shines on the view port and can easily be seen by an operator.

8. The dispenser of claim 1, further comprising:

(a) the dispenser receiving a diluent and outputting a use dilution comprising a chemical product diluted by the diluent, wherein a dispensing rate of chemical product for the dispenser varies with a temperature of the diluent; and (b) a temperature sensor sensing the temperature of the diluent and outputting a temperature signal representative thereof; and (c) a controller, coupled to the dispenser and the temperature sensor, the controller operating the dispenser to dispense an amount of use dilution having a predetermined amount of chemical product, wherein the controller dynamically varies a dispensing time of the dispenser while the dispenser is dispensing use dilution in response to the temperature signal to deliver the predetermined amount of chemical product.

* * * * *